US012420893B1

(12) United States Patent
Liang et al.

(10) Patent No.: US 12,420,893 B1
(45) Date of Patent: Sep. 23, 2025

(54) PADDLE FIN STRUCTURE

(71) Applicant: WEIHAI FUNWATER OUTDOOR CO., LTD, Weihai (CN)

(72) Inventors: Shengwei Liang, Weihai (CN); Zeguang Xiao, Weihai (CN); Xiaoye Xin, Weihai (CN)

(73) Assignee: WEIHAI FUNWATER OUTDOOR CO., LTD, Weihai (CN)

( * ) Notice: Subject to any disclaimer, the term of this patent is extended or adjusted under 35 U.S.C. 154(b) by 407 days.

(21) Appl. No.: 17/939,987

(22) Filed: Sep. 8, 2022

(30) Foreign Application Priority Data

Jul. 11, 2022 (CN) ..... 202221779316.1
Aug. 1, 2022 (CN) ..... 202222013691.1

(51) Int. Cl.
*B63B 32/66* (2020.01)
*B63B 1/24* (2020.01)
*B63B 32/62* (2020.01)

(52) U.S. Cl.
CPC ..... *B63B 32/66* (2020.02); *B63B 1/242* (2013.01); *B63B 32/62* (2020.02)

(58) Field of Classification Search
CPC ..... B63B 32/66; B63B 1/242; B63B 32/60; B63B 32/62; B63B 32/64
See application file for complete search history.

(56) References Cited

U.S. PATENT DOCUMENTS

2011/0271890 A1* 11/2011 Tsai ..... B63B 32/66 114/162
2013/0071178 A1* 3/2013 Bradley ..... F16B 47/003 403/270
2013/0178123 A1 7/2013 Ivory
2015/0307166 A1 10/2015 Zhou
2015/0336634 A1* 11/2015 Swan ..... B63H 16/06 114/364
2017/0001695 A1 1/2017 Lowry
2020/0010156 A1* 1/2020 Miller ..... B63B 32/66
2023/0174200 A1* 6/2023 Curtin ..... B63B 32/66 441/79

* cited by examiner

*Primary Examiner* — Andrew Polay

(57) ABSTRACT

The disclosure provides a paddle fin structure, which comprises a fin body and a base, wherein the fin body is inserted into and connected with the base through a pin. The pin is adopted to replace the traditional strip wire connection, and the installation and disassembly are convenient. At the same time, the special fin structure is adopted, which can effectively improve the flow diversion, reduce the resistance, improve the water diversion function, and increase the traveling speed.

7 Claims, 3 Drawing Sheets

PADDLE FIN STRUCTURE

TECHNICAL FIELD

The present disclosure relates to the field of paddle equipment, in particular to a paddle fin structure.

BACKGROUND ART

The fin structure is mainly used to control the stability of the paddle or to assist the surfer in turning movements on the wave wall. In the existing paddle-board fin structure, the fin body and the base are usually connected by a bolt with a wire, which is easy to fall off, and the fin itself has a general function of water diversion, which affects the traveling speed.

Therefore, there is an urgent need for a paddle fin structure, which can solve the problems of unstable connection and poor water diversion effect of the existing paddle fin structure.

SUMMARY

The present disclosure provides a paddle fin structure to solve the problems of unstable connection of the existing paddle fin structure and poor water separation effect.

To achieve the above object, the present disclosure provides the following scheme:

The present disclosure provides a paddle fin structure, comprising a fin body and a base, wherein the fin body is inserted into the base, and the fin body and the base are connected by a pin.

Preferably, the fin body and the base are made of PA6 material, and the pin is made of ABS material.

Preferably, the bottom surface of the fin body is provided with a connecting part, the connecting part is provided with fastening hooks and an insertion hole side by side, and the fastening hooks are arranged backward.

Preferably, the front part of the fin body is a middle thick structure with thin sides.

Preferably, the rear part of the fin body is provided with a guide groove.

Preferably, a connecting groove is arranged in the middle of the upper surface of the base, the connecting groove is fitted with the connecting part, and the connecting groove is provided with a card groove which is fitted with the fastening hooks, the side of the connection groove is provided with a socket opposite to the insertion hole, and the pin penetrates into the insertion hole through the socket.

Preferably, the socket is provided with a hidden buckle grill.

Preferably, the lower surface of the base is provided with a honeycomb structure. Preferably, the bottom of the base is provided with a groove.

Compared with the prior art, the present disclosure achieves the following beneficial technical effects:

The present disclosure provides a paddle fin structure, comprising a fin body and a base, wherein the fin body is inserted into the base and connected with the base through a pin, and the pin is used to replace the traditional strap connection to facilitate installation and disassembly. At the same time, the special fin design structure can effectively improve the flow guidance, reduce the resistance, improve the water distribution, increase the speed of travel.

BRIEF DESCRIPTION OF THE DRAWINGS

In order to explain the embodiments of the present disclosure or the technical solutions in the prior art more clearly, the following drawings that need to be used in the description of the embodiments or the prior art will be briefly introduced. It should be understood that the following drawings show only some embodiments of the present disclosure and should not be regarded as limiting the scope. For those of ordinary skill in the art, other drawings can be obtained based on the drawings disclosed without creative work.

In the figure: 1: Fin body, 101: Connecting part, 102: Fastening hook, 103: Insertion hole, 104: Guide groove, 2: Base, 201 Connecting groove, 202: Card groove, 203: Socket, 204: Hidden buckle grill, 205: Honeycomb structure, 206: Groove.

DETAILED DESCRIPTION OF THE EMBODIMENTS

Technical solutions of the present disclosure will be clearly and completely described below with reference to the drawings in the embodiments. Obviously, the described embodiments are only part of the embodiments of the present disclosure, not all of them. Based on the embodiments of the disclosure, all other embodiments made by those skilled in the art without sparing any creative effort should fall within the protection scope of the present disclosure.

The purpose of the present disclosure is to provide a paddle fin structure to solve the problems of unstable connection and poor water distribution effect of the existing paddle fin structure.

In order that the above objects, features and advantages of the present disclosure may be more clearly understood, the present disclosure will be described in further detail with reference to the drawings and the detailed description thereof.

Embodiment 1

Figure 1:
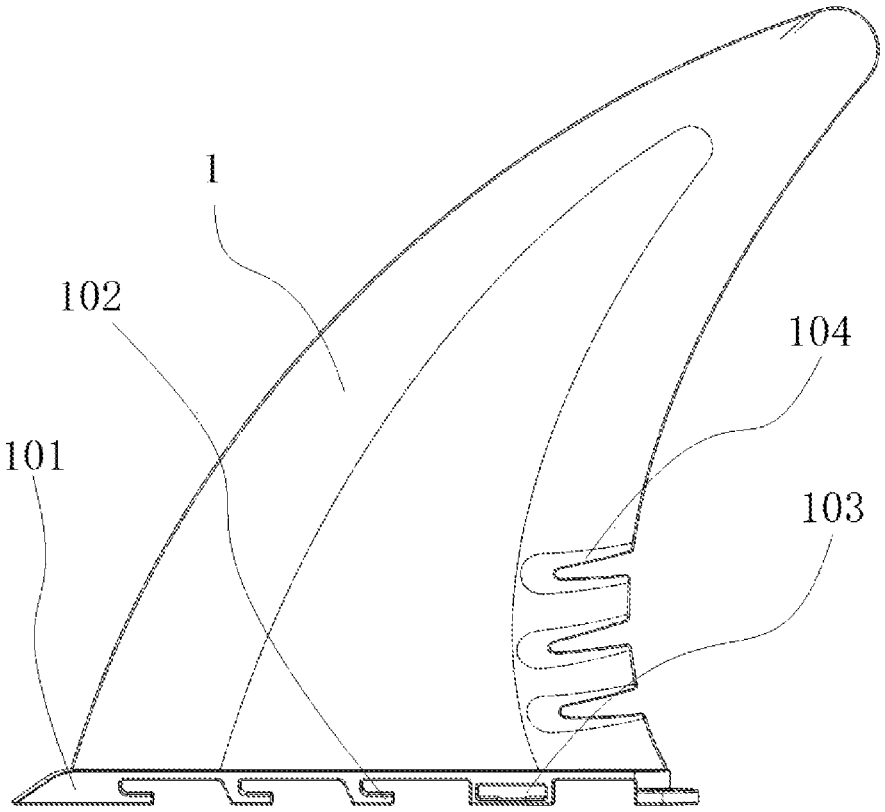
FIG. 1 is a schematic structural diagram of a fin body part of a paddle fin structure provided by the present disclosure.
Figure 2:
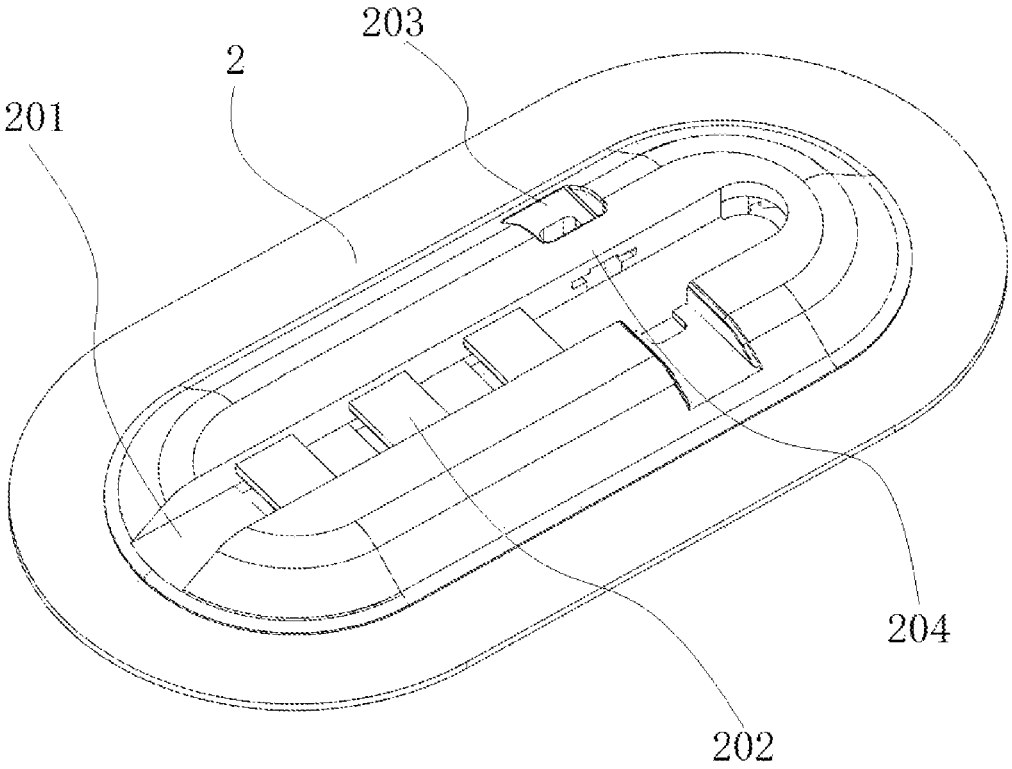
FIG. 2 is a structural diagram of the upper surface of the base part of the paddle fin structure provided by the present disclosure.
Figure 3:
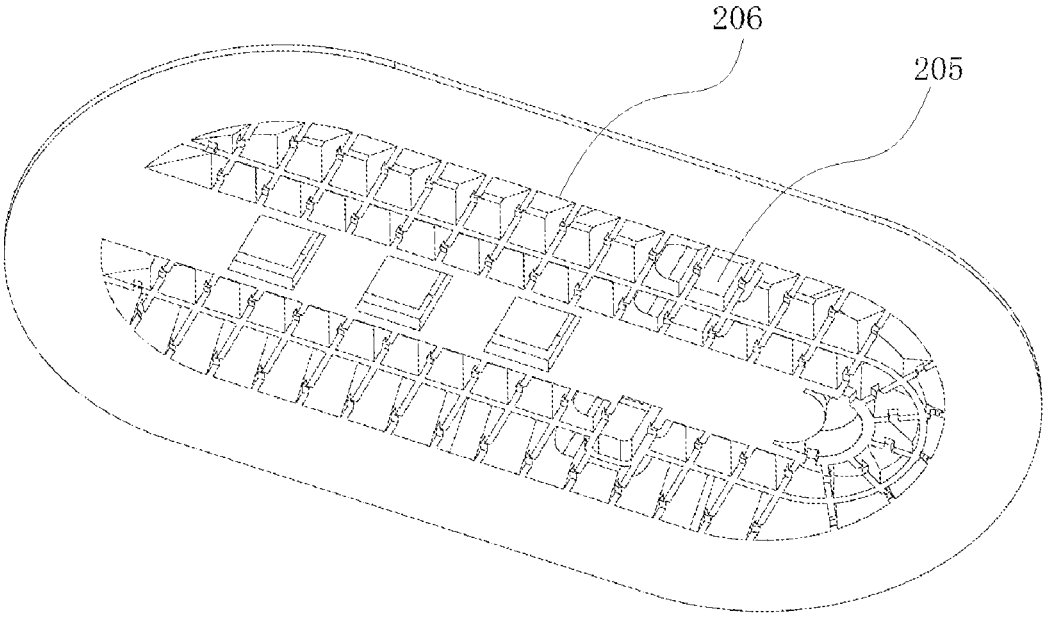
FIG. 3 is a structural diagram of the lower surface of the base part of the paddle fin structure provided by the present disclosure.

Referring to FIG. 1-3, the embodiment provides a paddle fin structure, comprising a fin body 1 and a base 2, the fin body 1 is inserted into the base 2, and the fin body 1 and the base 2 are connected by a pin.

Further, the fin body 1 and the base 2 are made of PA6 material, and the pin is made of ABS material.

Further, as shown in FIG. 1, the bottom surface of the fin body 1 is provided with a connecting part 101, and the connecting part 101 is provided with a fastening hook 102 and an insertion hole 103 side by side. Compared with the prior art, in the present disclosure, the buckle type link mode is adopted, the stress direction of the bottom of the fin body 1 can be changed, the structural strength is increase, and the bottom is not easy to deform.

Further, the front portion of the fin body 1 has a structure with a thick middle portion and two thin sides, so that the flowing water resistance can be reduced and the traveling speed can be improved.

Further, the rear portion of the fin body 1 is provided with three guiding grooves 104, the angles from bottom to top are respectively 13 degrees, 9.5 degrees and 9 degrees. In that course of the flow, the flow resistance is reduced and the traveling speed is increase by proper angle diversion.

For understanding, it is noted here that the location of guide grooves 104 of the fin body 1 is limited to the rear part of fin body 1. In the present disclosure, "backward" refers to the horizontal direction towards the guide grooves 104.

Further, as shown in FIG. 2, the middle of the upper surface of the base 2 is provided with a connecting groove 201, the connecting groove 201 is engaged with the connecting part 101, the connecting groove 201 is provided with a card groove 202 engaged with the fastening hook 102. In addition, that side of the connecting groove 201 is provided with a socket 203 opposite to the insertion hole 103, and the pin is insert into the insertion hole 103 through the socket 203, which is more convenient and secure than the traditional wired connection. In order to fully consider that usage habits of human body, the position width of the socket 203 is just the size of the palm and thumb of a normal adult, and the structure is optimized to improve the user experience.

Further, the socket 203 is provided with a hidden buckle grill 204, which can be hooked to the fastening hook, so that the fastening hook is not easy to fall off and is easy to store.

Further, as shown in FIG. 3, the bottom surface of the base 2 is provided with a honeycomb structure 205, the thickness of the bottom is increased, and the original flat bottom is changed into a honeycomb thick bottom, so that the force can be dispersed in both transverse and longitudinal directions to ensure that it is not easy to deform.

Further, the bottom of the base 2 is provided with a groove 206 for the purpose of allowing gas to flow through the bottom when glued on the paddle board so as not to thermally expand the blocking gas due to the high temperature in the summer, so that the paddle fin structure to bulge and can not to be used.

The present disclosure provides a paddle fin structure, which is used by gluing the base 2 to a proper position of the paddle, inserting the connecting part 101 of the fin 1 into the connecting groove 201 of the base 2, and engaging the buckle 102 with the card groove 202. At this time, the insertion hole 103 and the socket 203 are positioned opposite to each other, and a stable connection can be achieved by inserting the pin.

In the present disclosure, the principle and implementation mode of the present disclosure are illustrated by using specific example, and the above examples are only for helping to understand the method and the core idea of the present disclosure; meanwhile, for those of ordinary skill in the art, there will be changes in the specific embodiments and the scope of application according to the idea of the present disclosure. In summary, that content of this specification should not be construed as limit the present disclosure.

What is claimed is:

1. A paddle fin structure, comprising a fin body and a base, wherein the fin body is inserted into the base, and the fin body and the base are connected by a pin;

the bottom surface of the fin body is provided with a connecting part, the connecting part is provided with fastening hooks and an insertion hole side by side, and the fastening hooks are arranged backward;

a connecting groove is arranged in the middle of the upper surface of the base, the connecting groove is fitted with the connecting part, and the connecting groove is provided with a card groove which is fitted with the fastening hooks, the side of the connection groove is provided with a socket opposite to the insertion hole, and the pin penetrates into the insertion hole through the socket.

2. The paddle fin structure according to claim 1, wherein the fin body and the base are made of PA6 material, and the pin is made of ABS material.

3. The paddle fin structure according to claim 1, wherein the front part of the fin body is a middle thick structure with thin sides.

4. The paddle fin structure according to claim 1, wherein the rear part of the fin body is provided with a guide groove.

5. The paddle fin structure according to claim 1, wherein the socket is provided with a hidden buckle grill.

6. The paddle fin structure according to claim 1, wherein the lower surface of the base is provided with a honeycomb structure.

7. The paddle fin structure according to claim 1, wherein the bottom of the base is provided with a groove.

* * * * *